United States Patent [19]

Van Delm

[11] Patent Number: 4,751,432

[45] Date of Patent: Jun. 14, 1988

[54] HIGH-PRESSURE DISCHARGE LAMP

[75] Inventor: Marc G. A. M. Van Delm, Turnhout, Belgium

[73] Assignee: U.S. Philips Corporation, New York, N.Y.

[21] Appl. No.: 841,902

[22] Filed: Mar. 20, 1986

[30] Foreign Application Priority Data

Apr. 3, 1985 [NL] Netherlands ..... 8500982

[51] Int. Cl.[4] ..... H05B 35/00; H05B 37/00; H05B 39/00; H05B 41/00

[52] U.S. Cl. ..... 315/178; 315/46; 315/74; 315/185 R; 315/189; 315/193

[58] Field of Search ..... 315/178, 179, 180, 182, 315/186, 193, 46, 49, 73, 74, 75, 185, 189, 190, 311, 312, 323

[56] References Cited

U.S. PATENT DOCUMENTS

| | | | |
|---|---|---|---|
| 2,017,719 | 10/1935 | Inman | 315/48 X |
| 2,043,023 | 6/1936 | Westendorp | 315/182 |
| 2,203,550 | 6/1940 | Spanner | 315/49 |
| 2,208,998 | 7/1940 | Mey | 315/49 |
| 2,714,689 | 8/1955 | Waguet | 315/179 X |
| 4,287,454 | 9/1981 | Feuersanger et al. | 315/178 |
| 4,321,506 | 3/1982 | Tsuchihashi et al. | 315/178 |

*Primary Examiner*—Saxfield Chatmon

*Attorney, Agent, or Firm*—Algy Tamoshunas; Brian J. Wieghaus

[57] ABSTRACT

The invention relates to a high-pressure discharge lamp comprising an outer bulb accommodating a first and a second discharge vessel, these discharge vessels being connected electrically in series. According to the invention, the second discharge vessel is electrically shunted by a bimetal switch which is closed at a temperature of at least 300 K. The lamp thus starts in two steps, which facilitates the starting process and renders it more reliable.

3 Claims, 1 Drawing Sheet

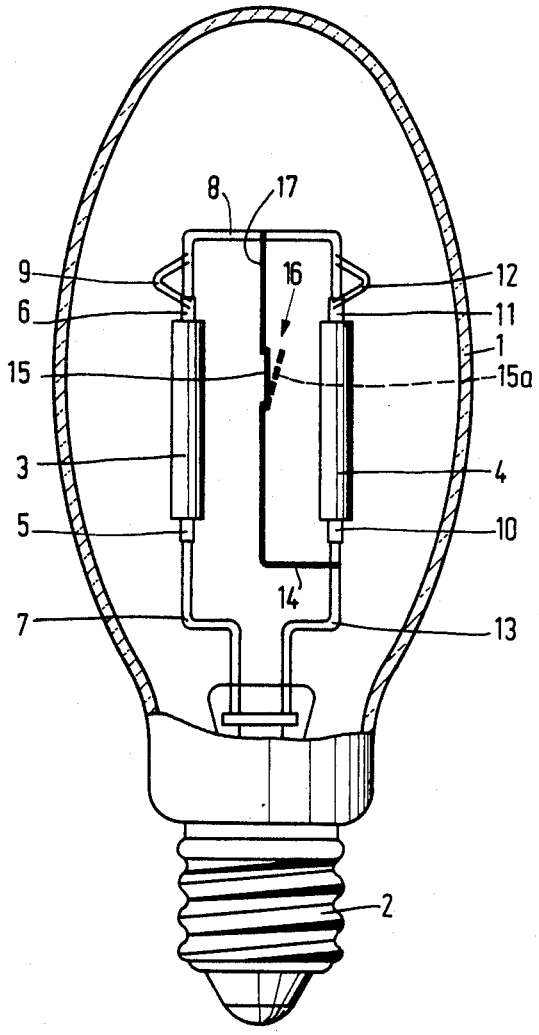
8
17
9
16
12
6
11
1
15
15a
3
4
5
10
14
7
13
2

HIGH-PRESSURE DISCHARGE LAMP

BACKGROUND OF THE INVENTION

The invention relates to a high-pressure discharge lamp comprising an outer bulb accommodating at least a first and a second discharge vessel, these discharge vessels being connected electrically in series. Such a lamp is known from British Patent Specification No. 1,332,852. With the known lamp, it is possible to influence the color of the light emitted by the lamp by using, for example, different types of discharge vessels. Upon starting of the known lamp, discharges will start simultaneously in each of the discharge vessels and the further starting behaviour of one discharge will be influenced by that of the other, and conversely. This may give rise to the problem of a poor start of the lamp.

SUMMARY OF THE INVENTION

The invention has for its object to provide means for solving the said problem. For this purpose, a lamp of the kind mentioned in the opening paragraph is characterized in that the second discharge vessel is electrically shunted by a bimetal switch, which is closed at least at a temperature of 300° K. or lower.

A lamp according to the invention affords the advantage that upon starting, a discharge starts in the first discharge vessel and a discharge does not start in the second discharge vessel until the bimetal switch is opened. A further advantage is that the starting operation in the first discharge vessel is effected by a voltage increased with respect to first discharge vessel, which reduces the necessity of the use of separate starting facilities. This may be explained as follows. The proportioning of the two discharge vessels should be chosen so that the sum of the arc voltages in each of the discharge vessels is adapted to the supply voltages at which the lamp is operated. However, upon starting of the lamp, the same supply voltage and the ignition pulse that may be superimposed on it are solely applied to the first discharge vessel.

The invention is based on the recognition of the fact that a discharge is not started in the second discharge vessel until the discharge in the first discharge vessel has increased so far that a sufficient amount of heat is developed to cause the bimetal switch to be opened.

In an advantageous embodiment of the lamp, the first and second discharge vessels are arranged for the major part beside each other. This has the advantage that during ignition of the lamp, the heat development due to the discharge in the first discharge vessel causes the second discharge vessel to be heated. Due to heating of the second discharge vessel, the ignition of a discharge in this discharge vessel is favored.

Preferably, in a lamp according to the invention, the bimetal switch is mounted between the two discharge vessels, as a result of which on the one hand the bimetal is satisfactorily heated during operation of the lamp and on the other hand a minimum influence is exerted on the light emitted by the lamp.

An embodiment of a lamp according to the invention will now be described more fully with reference to the accompanying drawing.

DESCRIPTION OF THE PREFERRED EMBODIMENTS

In the drawing, an outer bulb 1 is provided with a lamp cap 2, in which a first and second discharge vessel 3 and 4, respectively, are accommodated. The first discharge vessel 3 is provided with current supply members 5 and 6 in the form of niobium sleeves. The current supply member 5 is connected to a current conductor 7. A current conductor 8 is passed with a certain amount of clearance at one end into the niobium sleeve 6. A good electrical contact between these two elements is ensured by a Litze wire 9.

The second discharge vessel 4 is provided in the same manner as the discharge vessel 3 with current supply members 10 and 11 in the form of niobium sleeves, the current conductor 8 being passed with a certain amount of clearance into the niobium sleeve 11 and a Litze wire 12 ensuring a good electrical contact between these two elements. The current supply member 10 is connected to a current conductor 13.

The current conductors 7 and 13 are each connected in a usual manner to a separate connection contact (not shown) of the lamp cap 2.

A current conductor 14 is connected at one end to the current conductor 13. The other end of the current conductor 14 is provided with a bimetal element 15 of the bimetal switch 16, which in the extinguished state of the lamp bears on a current conductor 17, which is connected to the current conductor 8.

A broken line **15*a* indicates the position the bimetal element 15 occupies in the operating state of the lamp, which corresponds to the opened state of the bimetal switch 16. The bimetal switch 16 is mounted between the two discharge vessels 3 and 4**, the discharge vessels being arranged beside each other.

In the example described, the two discharge vessels are constructed as high-pressure sodium vapour discharge vessels having a polycrystalline densely sintered translucent wall of aluminum oxide. In the operating state of the lamp, each discharge vessel contains a discharge ac having an arc voltage of 50 V, while a power of about 50 W is dissipated by each discharge vessel. Thus, the lamp obtained consumes a power of 100 W and is suitable to be operated with a stabilization ballast at a supply source of 220 V, 50 Hz.

Upon starting of the lamp described, after a discharge had been produced in the first discharge vessel 3, the contact between the current supply conductor 17 and the bimetal element 15 was interrupted at the instant at which the bimetal element has a temperature of about 400° K. Since a strong atmospheric pressure prevailed in the space within the outer bulb 1, the bimetal element was heated substantially entirely by direct irradiation of the bimetal element by the discharge in the first discharge vessel.

When the bimetal switch was opened, a voltage pulse occurred across the second discharge vessel 4, after which a discharge was produced in the second discharge vessel.

The voltage pulse across the second discharge vessel, which occurred upon interruption of the contact between the bimetal element 15 and the current conductor 17, had a value of more than 5000 V. Due to the discharge in the first discharge vessel, only a voltage pulse of about 1000 V remained of this voltage pulse at the connection terminals of the lamp. This is a great advantage because it is now possible for the lamp to be operated with a stabilization ballast which is not provided with a means for protection against overload.

In a further embodiment of the lamp according to the invention, the first discharge vessel was a quartz glass high-pressure mercury vapour discharge vessel and the second discharge vessel was a high-pressure sodium vapour discharge vessel. Other combinations, such as, for example, with a metal halide filling of a discharge vessel, are possible.

A further possibility is that the discharges in the discharge vessels have different arc voltages. This may be a further advantage for the starting behaviour of the lamp.

What is claimed is:

1. A high-pressure discharge lamp comprising an outer bulb accommodating at least a first and a second discharge vessels, these discharge vessels being connected electrically in series, characterized in that the second discharge vessel is electrically shunted by a bimetal switch which is closed at least at a temperature of 300° K. or lower.

2. A lamp as claimed in claim 1, characterized in that the first and second discharge vessels are arranged beside each other for the major part.

3. A lamp as claimed in claim 2, characterized in that the bimetal switch is mounted between the two discharge vessels.

* * * * *